US005527137A

United States Patent [19]

Spencer

[11] Patent Number: 5,527,137

[45] Date of Patent: Jun. 18, 1996

[54] KNIFE STRUCTURE FOR SHORING ASSEMBLIES USED IN EXCAVATIONS

[76] Inventor: Dennis I. Spencer, 12140 E. 116th Cir., Henderson, Colo. 80640

[21] Appl. No.: 236,419

[22] Filed: Apr. 29, 1994

[51] Int. Cl.[6] ..... E21D 5/12

[52] U.S. Cl. ..... 405/283; 405/282

[58] Field of Search ..... 405/282, 283, 405/284; 403/376, 405.1, 406.1, 407.1, 408.1; 52/582.1, 585.1

[56] References Cited

U.S. PATENT DOCUMENTS

| | | | |
|---|---|---|---|
| 3,937,026 | 2/1976 | Krings | 405/282 |
| 4,058,983 | 11/1977 | Griswold | 405/283 |
| 4,145,891 | 3/1979 | Krings | 405/282 |
| 4,345,857 | 8/1982 | Krings | 405/282 |
| 5,277,522 | 1/1994 | Pertz | 405/283 |
| 5,290,129 | 3/1994 | Rody et al. | 405/282 |

FOREIGN PATENT DOCUMENTS

| | | | |
|---|---|---|---|
| 23566 | 2/1981 | European Pat. Off. | 405/282 |
| 2476170 | 8/1981 | France | 405/282 |
| 3015110 | 10/1981 | Germany | 405/282 |
| 4202344 | 8/1993 | Germany | 405/282 |

*Primary Examiner*—Eric K. Nicholson
*Assistant Examiner*—John A. Ricci
*Attorney, Agent, or Firm*—Timothy J. Martin

[57] ABSTRACT

An improvement for use with protective panels that buttress the walls of an excavation is in the form of a knife structure that is releasably connected to the bottom edge of a protective panel by means of a plurality of cooperative connectors. The knife structure includes first and second knife walls attached at an acute angle to form a vertex edge. When secured by the connectors, the knife structure extends coextensively along the bottom edge of the panel. The knife structure preferably includes a top wall attached between the first and second knife walls, and the top wall and the first knife wall may be at a ninety degree angle to one another. Triangularly-shaped end plates and gusset plates may be included in the knife structure. Parallel guide walls may be mounted on the top wall to form a channel adapted to receive the bottom edge of the panel, and guide posts are located in the channel to mate with holes in the lower edge of the panel, if desired. The connectors are preferably axially aligned pairs, such as lugs, and a threaded rod may engage these lugs and be fastened to mount the knife structure. This improved structure may be used for each side panel where a protective structure incorporates plurality of side panels.

19 Claims, 4 Drawing Sheets

KNIFE STRUCTURE FOR SHORING ASSEMBLIES USED IN EXCAVATIONS

FIELD OF INVENTION

The present invention relates to shoring assemblies adapted for use in excavations in order to buttress the upright walls thereof. More particularly, the present invention is directed to knife structures removably connected to a shoring assembly so that, when the knife structures are connected to the shoring assembly, it can be embedded into the floor of the excavation. The present invention is specifically suitable for use with trench boxes.

BACKGROUND OF THE INVENTION

The construction industry often requires that excavations be made in the earth. In many instances, it is desirable to support the earthen upright walls of the excavation in order to prevent collapse. A collapsed wall or walls would require re-excavation, thus, causing delay and increased costs. Moreover, a collapsed wall could cause injury or death to a worker situated in the excavation. Recognizing potential hazards to excavation workers, governmental agencies have enacted regulations which require shoring assemblies to support the upright walls of the excavation in order to protect the workers. One such shoring assembly is a protective structure commonly referred in the construction industry as a "trench box" or a "trench shield."

The trench box is disposed in a trench and is operative to buttress its opposing upright walls. The trench box has a pair of side panels which are operative to support each other in a selected spaced-apart relationship by a plurality of spreader beams. When disposed in the trench, the trench box shores or otherwise prevents collapse of the upright walls of the excavation. One example of a trench box is disclosed in my patent number 5,310,290. Other examples of trench boxes are found in U.S. Pat. No. 4,090,365 issued May 23, 1978 to Nieber and U.S. Pat. No. 4,202,649 issued May 13, 1980 to Cook et al.

Presently, there are two types of trench boxes being used in the construction industry. One type of trench box includes a pair of side panels with each side panel having a knife-shaped bottom edge. Each knife-shaped bottom edge is integrally formed as part of the side panel. This type of trench box which is commonly used in the construction industry is hereinafter referred to as a "knife-edged trench box." Another type of trench box which is less commonly employed in the construction industry has a flat bottom edge. This type of trench box is hereinafter referred to as a "flat-bottom trench box." Knife-edged trench boxes have advantages over flat-bottom trench boxes. First, under certain soil conditions, such as muddy soil or sandy soil, the flat bottom trench boxes are inadequate because the muddy or sandy soil seeps under the flat bottom edges and infiltrates the work space. To resolve this problem, knife-edged trench boxes are employed. A downwardly force applied to the knife-edged trench box positioned in the excavation embeds the knife-edged trench box into the floor of the excavation. The embedded portion of the trench box now prevents muddy or sandy soil from seeping under the side panels and into the work space. Second, as the trench is dug deeper within the work space between the side panels of the trench box, the knife-edged trench box can be advanced downwardly to cut along the upright walls of the excavation, thus aiding in excavation.

Although knife-edged trench boxes provide the contractor with advantages, there is a corresponding problem associated with stacking of the knife-edged trench boxes. Sometimes, it is desirable to stack the trench boxes on top of each other as the excavation is dug deeper in order to maintain compliance with governmental regulations. Since the knife-edges are integrally formed with the side panels of the trench box, only one knife-edge trench box can safely be stacked onto another by inverting the top one and stacking it on the embedded knife-edged one. Thus, knife-edged trench boxes can only be stacked two high. In some excavating applications, it might be required that three or four trench boxes must be stacked onto one another. Therefore, if the bottom trench box is to be embedded, both flat-bottom trench boxes and knife-edged trench boxes must be employed in order to safely stack more than two trench boxes.

To facilitate stacking more than two trench boxes, a selected number of flat-bottom trench boxes and knife-edged trench boxes must be delivered to the excavation site. Occasionally, additional trench boxes could be utilized to advance progress of the excavation. Sometimes, knife-edged trench boxes are needed and while other times flat-bottom trench boxes are needed. Presently, the only way to resolve this dilemma is to supply additional trench boxes of both types than is initially anticipated to be needed. However, this solution is not cost efficient.

Also, some trench boxes are three-sided while others are four-sided. In certain circumstances, it may be desirable to have all three or all four sides of the trench box to have knife edges so it could be embedded into the floor of the excavation. For other applications, it might be desirable to have knife edges used on only the side panels while the front and rear panels have flat bottom edges.

Another type of shoring assembly is a protective panel which is a single panel supported by a brace in order to buttress a single upright wall of an excavation. Again, depending upon soil conditions, it may be desirable to employ a protective panel having either a flat bottom edge or a knife edge. Presently, the contractor must select which type and how many of each are needed before the protective panels are delivered to the excavation site.

There is a need in the construction industry to provide a shoring assembly that includes a removable knife-edge structure. The present invention addresses this need.

SUMMARY OF INVENTION

It is an object of the present invention to provide a new, useful and improved shoring assembly such as a protective structure or a protective panel that has a removable knife structure which can be connected to or removed from the shoring assembly when desired thereby to increase the versatility of each protective structure or panel.

A further object of the present invention is to provide a shoring assembly with a removable knife structure so that, when desired, the knife structure can be connected to the side panels of the shoring assembly to facilitate embedding the shoring assembly into a floor of an excavation.

Still another object of the present invention is to provide a shoring assembly with a removable knife structure so that, when the shoring assembly is embedded into the floor of the excavation, infiltration of muddy soil or loose soil into the work space located between the side panels is inhibited.

It is another object of the present invention to provide a shoring assembly with a removable knife structure whereby embedding the shoring assembly into a floor of an excavation results in increased strength capacity of the shoring assembly.

Yet another object of the present invention is to provide a shoring assembly with a removable knife structure so that when the knife structure is connected thereto and the shoring assembly is positioned in the excavation to buttress the upright sidewall thereof, advancing the knife structure into the floor of the excavation spreads opposing bottom portions of the shoring structure thereby inducing a lateral force which diametrically opposes potential collapsing forces of the upright walls.

Accordingly, the present invention is directed to a shoring assembly such as a protective panel and a protective structure. The protective panel is adapted to be supported by a brace in order to buttress an upright wall of an excavation that has a floor. The protective panel has a bottom edge normally operative to contact the floor of the excavation. In its broadest form, the protective panel includes a knife structure releasably mounted to the bottom edge of the protective panel by a plurality of connector elements. The knife structure is formed by a first knife wall attached to a second knife wall at an acute angle to form a vertex edge. The knife structure is adapted to extend coextensively along the bottom edge of the protective panel and to project downwardly therefrom.

The plurality of connector elements are attached to the knife structure and the protective panel. The plurality of connector elements are operative to releasably connect the knife structure to the protective panel so that, when the knife structure is connected to the protective panel and the protected panel is positioned in the excavation to buttress the upright wall with the vertex edge contacting the floor of the excavation, the knife structure is operative to advance into the floor as a downwardly force is applied to the protective panel. As a result of the downwardly force on the protective panel, the protected panel is embedded into the floor of the excavation. The plurality of connector elements are arranged as axially-aligned pairs when the knife structure and protective panel are releasably connected to each other. First ones of each pair are attached to the knife structure and second ones of each pair are attached to the protective panel. For each axially-aligned pair of connector elements, the present invention includes a threaded rod and a pair of fastening elements which are adapted to matably engage the threaded rod. It is preferred that each of the connector elements is a lug member adapted to receive end portions of the threaded rod so that each of the axially-aligned pairs of connector elements is interconnected by the threaded rod matably engaged with the pair of fastening elements.

A top wall is attached to and between the first knife wall and the second wall of the knife structure and is adapted to abut the bottom edge of the protective panel when the knife structure is releasably connected to the protective panel. The top wall and the first knife wall form a 90° angle therebetween when attached to each other.

The knife structure also preferably includes a pair of triangularly-shaped end plates. Each end plate is attached to the top wall, the first knife wall and the second knife wall at opposite longitudinal ends of the knife structure. The knife structure also includes a plurality of triangularly-shaped gusset plates which are attached to at least one of the top wall, first knife wall and the second knife wall in a spaced-apart relationship to each other between the end plates. The knife structure also includes a first guide wall and a second guide wall. Each of the guide walls is connected to the top wall in a spaced-apart parallel relationship to each other to form a rectangularly-shaped channel which is operative to receive the bottom edge of the protective panel. The first guide wall is an integral extension of the first knife wall thereby defining an outside wall operative to extend and abut the upright sidewall of the excavation when the protective panel is embedded into the floor thereof. The second guide wall and the second knife wall are integrally formed at an obtuse angle relative to each other to define a canted inside wall which is operative to cut the floor of the excavation when the protective panel is being advanced into the excavation. An alternative embodiment of the knife structure includes a plurality of guide posts attached to and extending perpendicularly from the top wall of the knife structure. A plurality of guide holes are formed into the bottom edge of the protective panel and are arranged to axially align with respective ones of the plurality of guide posts for slidable engagement therewith.

By providing a pair of knife structures, the present invention can be employed with a protective structure. The protective structure is adapted for use to buttress opposing upright walls of an excavation that has a floor. The protective structure has a pair of side panels operative to support each other in a selected spaced-apart relationship by a plurality of spreader beams so that the protective structure can be placed into the excavation with each side panel positioned in proximity to a respective one of the upright walls of the excavation. Each of the side panels of the protective structure has a bottom edge normally operative to contact the floor of the excavation. Each of the knife structures is releasably connected along a respective one of the bottom edges of each of the side panels.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

A knife structure of the present invention is adapted to be releasably connected to shoring assemblies which are employed in the excavation industry. A skilled artisan would appreciate that the excavation industry uses a variety of shoring assemblies. One type of shoring assembly is a protective structure commonly referred to in the construction industry as a "trench box". Typically, the trench box has a pair of side panels operative to support each other in a select spaced-apart relationship by a plurality of spreader beams and is opened at opposite ends. A trench box may include an additional panel which extends between the side panels to enclose one end or two panels extending between the side panels to enclose both ends. Another type of shoring structure is a protective panel. Typically, the protective panel is a single panel which is supported by a brace to buttress an upright wall of the excavation. Although the description of the exemplary embodiments encompasses shoring assemblies in the form of a protective structure and a protective panel, one of ordinary skill in the art would appreciate that the knife structure of the present invention can be releasably connected to other types of shoring assemblies.

Figure 1:
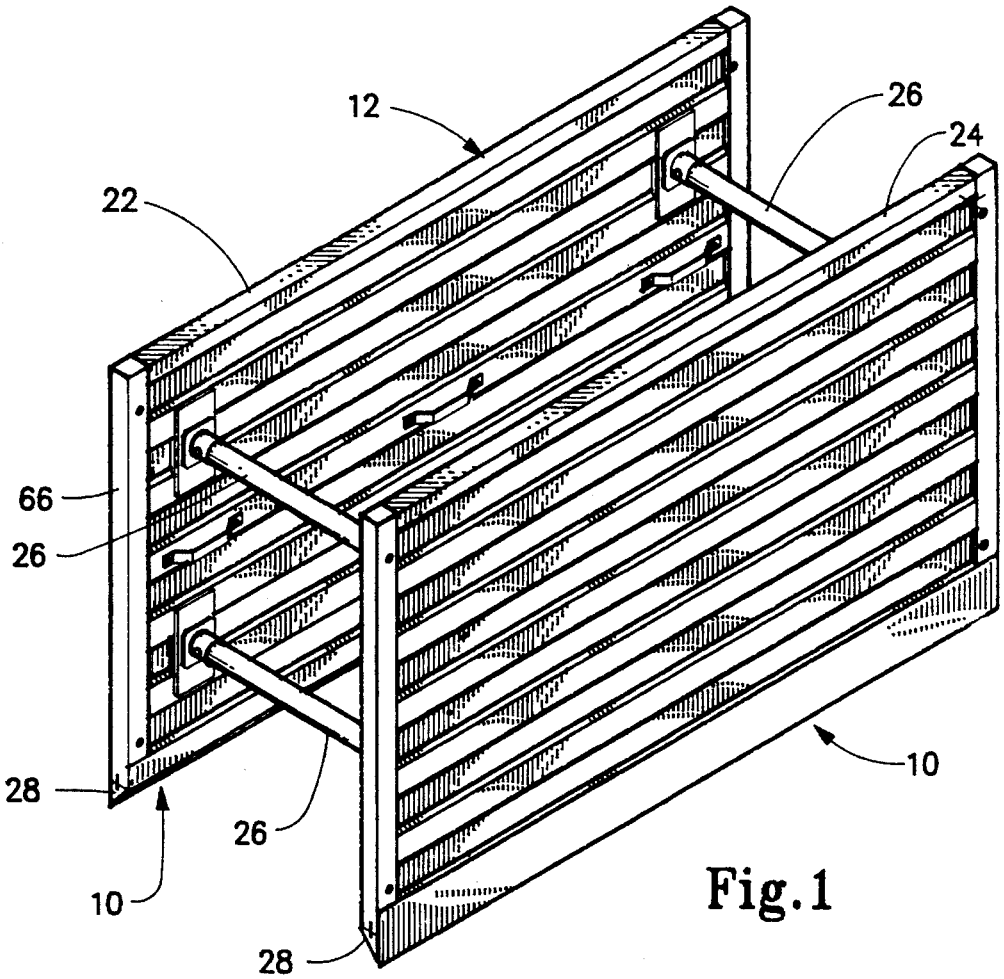
FIG. 1 is a perspective view of a shoring assembly in the form of a protective structure having a pair of side panels supported by a plurality of spreader beams with each side panel releasably connected to a knife structure of the present invention.
Figure 2:
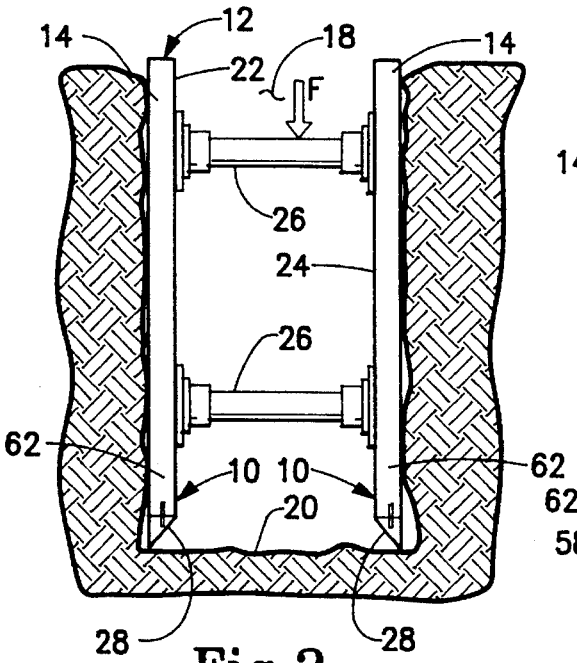
FIG. 2 is a side view in elevation of a shoring assembly in the form of a protective structure having a pair of knife structures releasably connected at a bottom edge thereof which disposed in an excavation.
Figure 3:
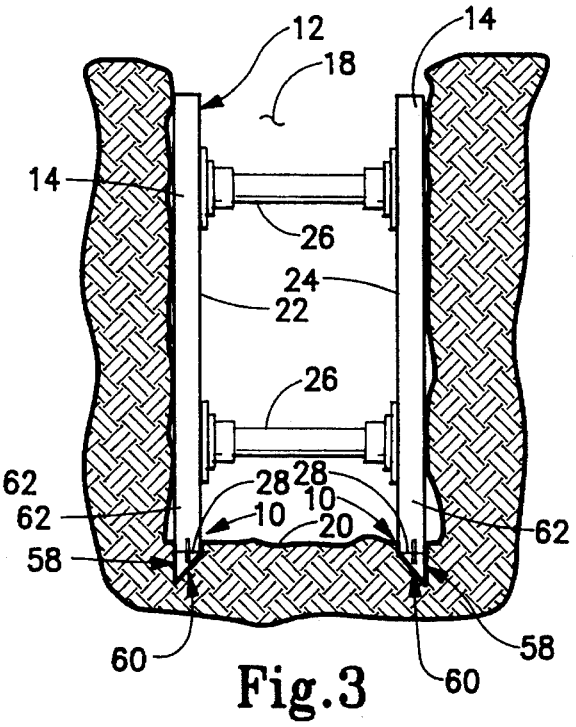
FIG. 3 is a side view in elevation of a protective structure having a pair of knife structures releasably connected to respective bottom edges thereof which is embedded into the floor of the excavation.

A knife structure 10 of the present invention is generally introduced in FIGS. 1–6. With reference to FIGS. 1–3, a shoring assembly in the form of a protective structure 12 is adapted for use to buttress opposing upright walls 14 of an excavation 18 which has a floor 20. Protective structure 12 has a pair of side panels 22 and 24 which are operative to support each other in a select spaced-apart relationship by a plurality of spreader beams 26 so that protective structure 12 can be placed into excavation 18 with each side panel 22 and 24 positioned in proximity to a respective one of upright walls 14 of excavation 18. Each of side panels 22 and 24 has a bottom edge 28 normally operative to contact floor 20 of excavation 18.

Figure 4:
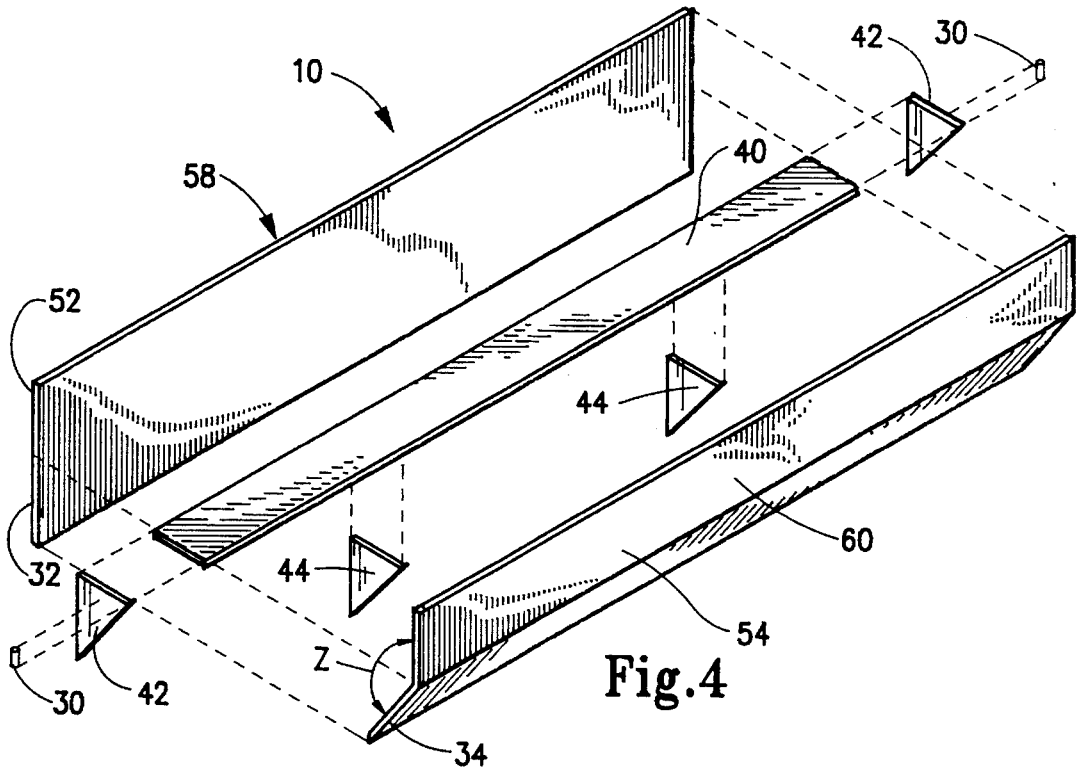
FIG. 4 is an exploded perspective view of one of the pair of knife structures shown in FIGS. 1–3.
Figure 6:
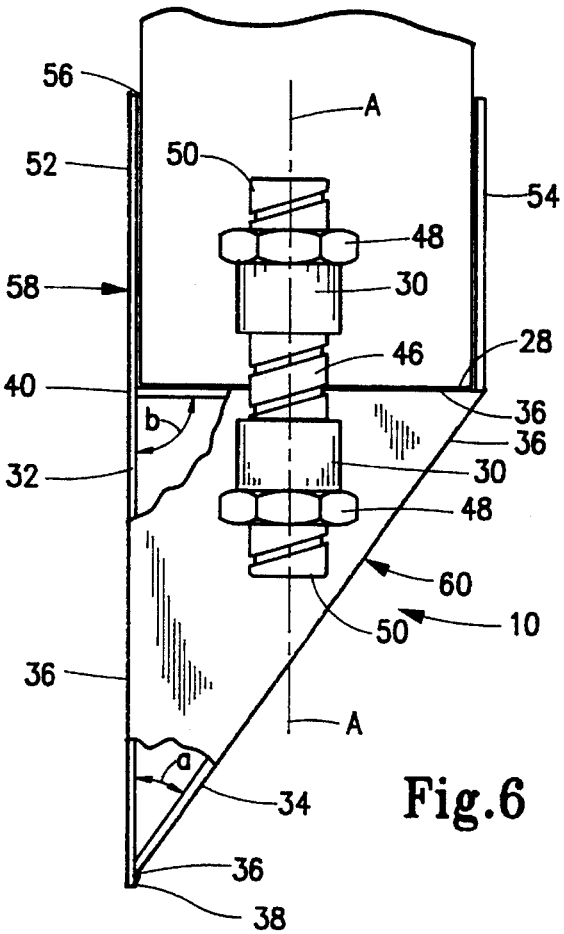
FIG. 6 is a side view in elevation, partially broken away, of the knife structure releasably connected to the bottom edge of the protective panel with an axially-aligned pair of connector elements interconnected by the threaded rod matably engaged with the pair of fastening elements.
Figure 5:
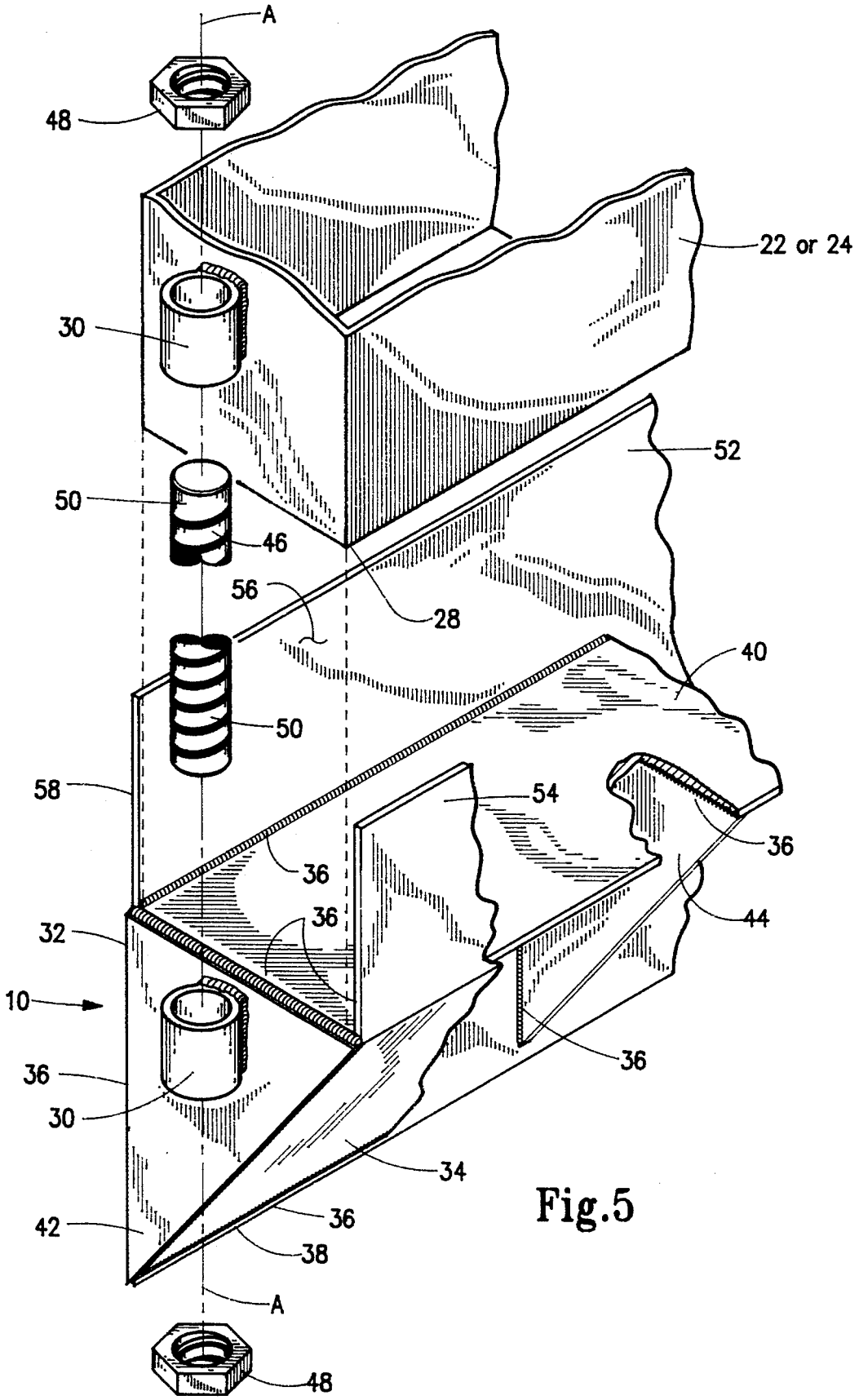
FIG. 5 is partial perspective view of the knife edge structure positioned adjacent to the bottom edge of the side panel with a pair of connector elements, a threaded rod and a pair of fastening elements shown in axial alignment.

As best shown in FIGS. 4–6, a pair of knife structures 10 and a plurality of connector elements 30 are associated with protective structure 12. Each knife structure 10 is formed by a first knife wall 32 attached to a second knife wall 34 by a weldment 36 at an acute angle "a" to form a vertex edge 38. Preferably, angle "a" is in a range of 20° and 45° and in the exemplary embodiment is 30°. Each knife structure 10 is adapted to extend coextensively along a respective bottom edge 28 of protective structure 12 and to project downwardly therefrom.

The plurality of connector elements 30 are attached to each of knife structures 10 and each of side panel 22 and 24 of protective structure 12. The plurality of connector elements 30 are operative to releasably connect each of knife structures 10 to respective ones of side panels 22 and 24 of protective structure 12. When knife structures 10 are connected to side panels 22 and 24 and protective structure 12 is positioned in excavation 18 to buttress upright walls 14 with respective vertex edges 38 contacting floor 20 of excavation 18, knife structures 10 are operative to advance into floor 20 as a downwardly force "F", shown in FIG. 2, is applied to protective structure 12. Thus, downwardly force "F" embeds protective structure 12 into floor 20 of excavation 18 as shown in FIG. 3.

Again, with reference to FIGS. 4–6, each knife structure 10 includes a top wall 40 attached to and between first knife wall 32 and second knife wall 34 of each of knife structures 10 by weldments 36. Top wall 40 is adapted to abut a respective bottom edge 28 of each side panel 22 and 24 of protective structure 12 when the pair of knife structures 10 are releasably connected thereto, as best shown in FIG. 6. It is preferred that respective ones of top walls 40 and first knife walls 32 form a 90° angle "b" therebetween when attached to each other.

As best shown in FIGS. 4 and 5, it is also preferred that each knife structure 10 includes a pair of triangularly-shaped end plates 42 and a plurality of gusset plates 44. Each end plate 42 is attached to respective ones of top walls 40, first knife walls 32 and second knife walls 34 at opposite longitudinal ends of each knife structure 10. Each end plate 42 is attached thereto by weldments 36 and the pair of end plates 42 enclose the opposite longitudinal ends of each of knife structure 10. Although not by way of limitation, the plurality of gusset plates 44 are equidistantly spaced-apart along and welded to first knife wall 32 and top wall 40 by weldments 36 as best shown in FIGS. 4 and 5. Gusset plates 44 add structural strength to knife structure 10.

With reference to axis "A" in FIGS. 5 and 6, the plurality of connector elements 30 of each knife structure 10 are arranged as axially-aligned pairs when knife structures 10 and protective structure 12 are releasably connected together. First ones of each axially-aligned pair of connector elements 30 are attached to each knife structure 10 and second ones of each axially-aligned pair of connector elements 30 attached to respective ones of side panels 22 and 24 of protective structure 12. A threaded rod 46 and a pair of fastening elements 48 are associated with each axially-aligned pair of connector elements 30 and are adapted to matably engage threaded rod 46 are provided. Although not by way of limitation, each of connector elements 30 is a lug member adapted to receive end portions 50 of threaded rod 46 so that each of axially-aligned pairs of connector elements 30 is interconnected by threaded rod 46 matably engaged with the pair of fastening elements 48. Specifically, fastening elements 48 are hexagonal-shaped nuts. However, one of ordinary skill in the art will appreciate that other mechanical devices are available in the marketplace in order to releasably connect knife structures 10 to protective structure 12.

Figure 7:
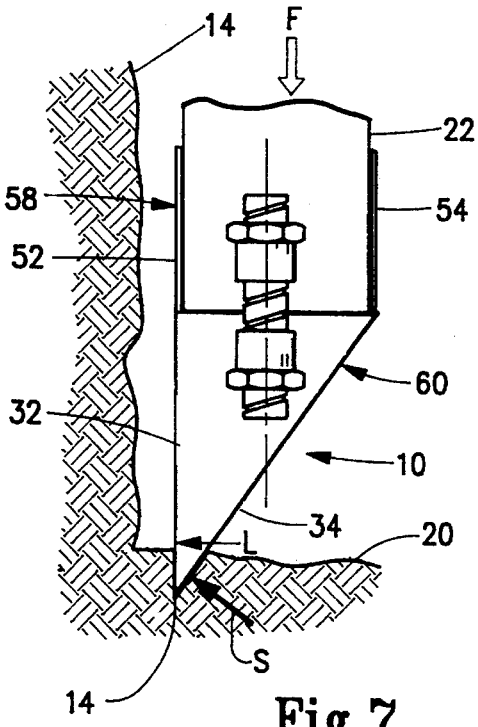
FIG. 7 is a side view in elevation of the knife structure of the present invention cutting the floor of the excavation and extending the upright wall thereof.

Again, with reference to FIGS. 4–6, knife structure 10 includes a first guide wall 52 and a second guide wall 54 which are associated with each of knife structures 10. Each of first and second guide walls 52 and 54 is connected to a respective one of top walls 40 of knife structures 10 in a spaced-apart parallel relationship to each other to form a rectangularly-shaped channel 56. A respective one of rectangularly-shaped channels 56 is operative to receive a respective one of bottom edges 28 of each side panel 22 and 24 of protective structure 12. First guide wall 52 of each of knife structures 10 is formed as an integral extension of a respective one of first knife wall 32 thereby defining an outside wall 58. Outside wall 58 is operative to extend and abut a respective one of the upright walls 14 of excavation 18 when protective structure 12 is embedded into floor 20 of excavation 18 as shown in FIG. 3. As shown in FIGS. 3 and 4, second guide wall 54 and second knife wall 34 of each of knife structure 10 are integrally formed at an obtuse angle "Z" formed relative to each other to define a canted inside wall 60. Angle "Z" is the supplementary angle with respect to angle "a". As shown in FIG. 7, canted inside wall 60 is operative to cut floor 20 of excavation 18 when protective structure 12 is being advanced thereinto.

One of ordinary skill in the art would appreciate that, while knife structures 10 is releasably connected to protective structure 12, outside wall 58 extends and abuts the upright walls 14 of excavation 18 and canted inside wall 60 operates to cut floor 20 of excavation 18. As knife structures 10 being releasably connected to protective structure 12 advance into floor 20 of excavation 18, canted inside wall 60 causes respective bottom portions of panel structure 12 to spread which, in turn, causes a spreading force "S" as shown in FIG. 7. This spreading force "S" induces a lateral force "L" against upright wall 14 which diametrically opposes forces which would be generated by upright wall 14 of the excavation 18, if it collapsed. Thus, lateral force "L" induced by canted side walls 60 of respective ones of knife structures 10 results in increased strength capacity of protective structure 12 having knife structures 10 releasably connected thereto compared to a similar conventional protective structure 10 without having knife structures. Furthermore, one of ordinary skill in the art would further appreciate that the strength capacity of an embedded protective structure 10 is further enhanced when a bucket of a backhoe digging between the side panels of the protective structure excavates therebetween. Since the volume of the bucket entering the earth causes expansion of the excavation as it digs, such expansion induces yet a greater lateral force "L" against upright walls 14 of excavation 18.

Figure 8:
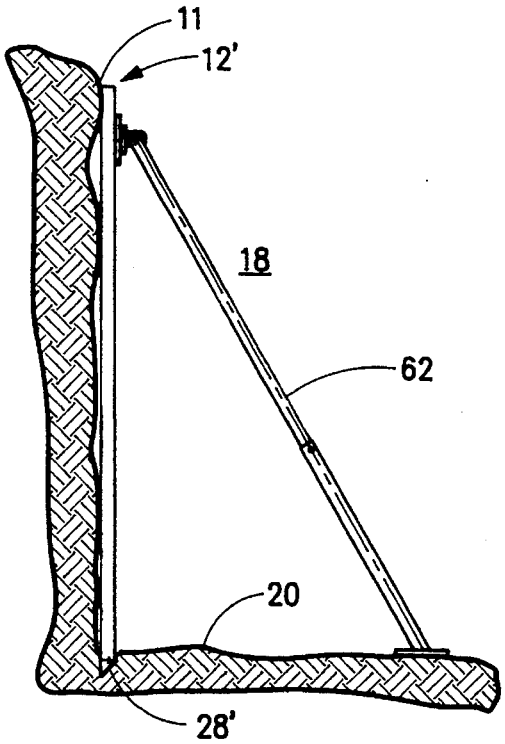
FIG. 8 is a side view in elevation of a protective shoring assembly in the form of a protective panel having a knife structure releasably connected thereto and shown embedded into a floor of an excavation.

In FIG. 8, a protective panel 12' is shown as an alternative shoring assembly. Protective panel 12' is adapted to be supported by a brace 62 to buttress upright wall 14 of excavation 18 that has a floor 20. Protective panel 12' has a bottom edge 28 normally operative to contact floor 20 of excavation 18. One of ordinary skill in the art would appreciate that knife structure 10 and the plurality of connector elements 30 as described hereinabove for use with protective panel 12' are identical except for the fact that panel structure 12 includes a pair of knife structures 10 whereas protective panel 12' includes only one knife structure 10. Therefore, all of the exemplary embodiments described herein are equally as applicable to protective panel 12' as with protective structure 12.

Figure 9:
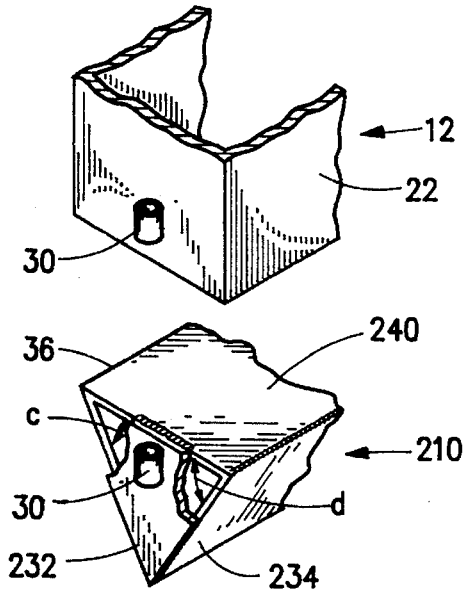
FIG. 9 is a partial perspective view of a second exemplary embodiment of a knife structure of the present invention disposed adjacent to an associated bottom edge of a side panel of a protective structure.

A second exemplary embodiment of a knife structure 210 is illustrated in FIG. 9. Knife structure 210 includes a top wall 240 which is attached to and between a first knife wall 232 and a second knife wall 234 by weldments 36. Top wall 240 and first knife wall 232 form a second acute angle "c"; top wall 240 and second knife wall 234 form a third acute angle "d". If second acute angle "c" and third acute angle "d" are equal to each other, then a skill artisan would appreciate that advancing protective structure 12 with knife structures 210 of the second exemplary embodiment of the present invention releasably connected thereto will not produce lateral forces to spread the side panels to resist collapsing forces. However, the second exemplary embodiment of the present invention releasably connected to panel structure 12 would, however, prevent muddy or loose soil from infiltrating the work space located between the side panels.

Figure 10:
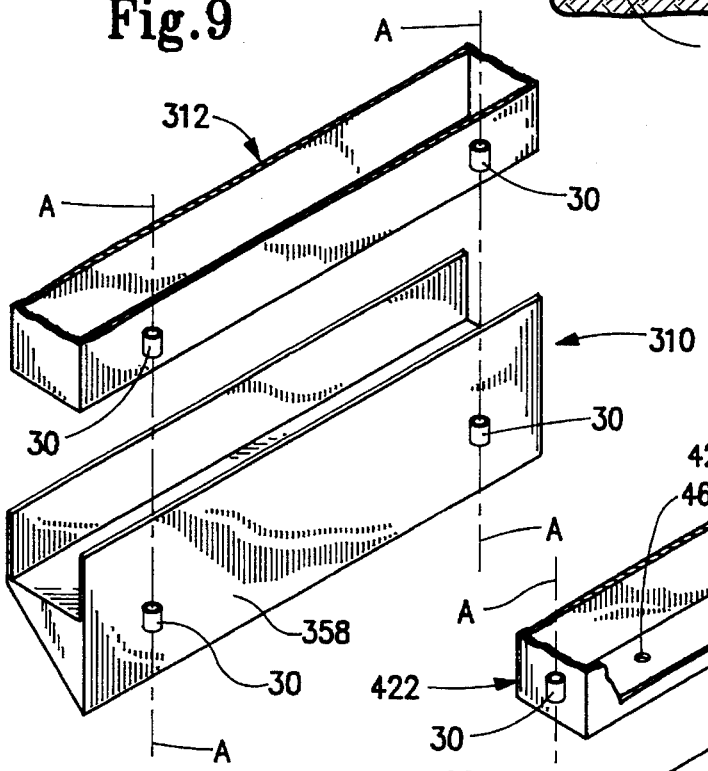
FIG. 10 is a perspective view of a third exemplary embodiment of a knife structure of the present invention shown disposed adjacent to an associated bottom edge of a side panel of a protective structure.

A third exemplary embodiment of a knife structure 310 of the present invention is depicted in FIG. 10. First ones of each axially-aligned pair of connector elements 30 are attached to outside wall 358 of knife structure 310. Second ones of each pair of axially-aligned connector elements are shown aligned along axis "A" to the protective structure 312.

Figure 11:
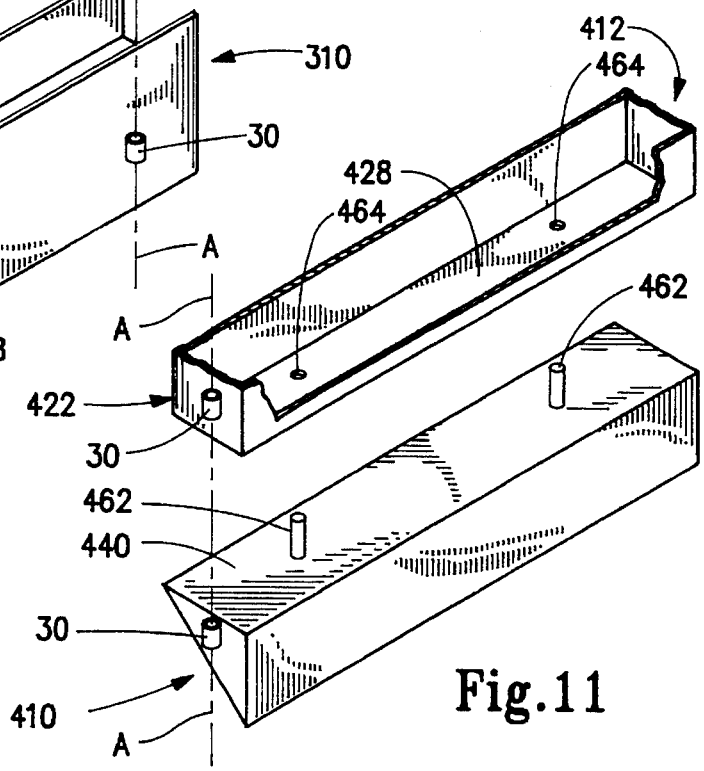
FIG. 11 is a perspective view of a fourth exemplary embodiment of a knife structure of the present invention shown disposed adjacent to an associated bottom edge of a side panel of a protective structure.

A fourth exemplary embodiment of a knife structure 410 of the present invention is depicted in FIG. 11. A plurality of guide posts 462 are attached to and extend perpendicularly from a top wall 440 of knife structure 410. A plurality of guide holes 464 are formed into a bottom edge 428 of a side panel 422 and are arranged to axially align with respective ones of the plurality of guide posts 462 for slidable engagement therewith. Having guide posts 462 and corresponding guide holes 464 facilitates alignment and ease of mounting of knife structure 410 onto protective structure 412 before releasably connecting knife structure 410 thereto.

The knife structure of the present invention can be adapted to shoring assemblies such as protective structures and protective panels. The knife structure of the present invention can be releasably connected to conventional shoring assemblies in order to increase their strength capacities. Strength capacity of a conventional shoring assembly is increased simply by advancing the knife structure of the present invention into the floor of the excavation which, in turn, spreads the bottom portions of the shoring structure to generate a lateral force opposing potential collapsing forces. Embedding a shoring assembly having the knife structure releasably connected thereto prevents infiltration of muddy soil or loose soil into the work space between the side panels of the shoring assembly. With the present invention, conventional shoring assemblies can be converted to a knife-edged shoring assembly and vice versa at the excavation site. Further, the knife structure of the present invention can be releasably connected to two, three or four panels of a four-panel trench box or to two or three panels of a three-panel trench box, if desired.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. In a protective panel adapted to be supported by a brace in order to buttress an upright wall of an excavation that has a floor wherein the protective panel has a bottom edge normally operative to contact the floor of the excavation, the improvement comprising:

(a) a knife structure adapted to be releasably mounted along the bottom edge of said protective panel, said knife structure formed by a first knife wall attached to a second knife wall at an acute angle to form a vertex edge and a top wall attached to and between said first knife wall and second knife wall and adapted to abut the bottom edge of the protective structure when said knife structure is releasably connected thereto, said knife structure extending coextensively along the bottom edge of the protective panel and projecting downwardly therefrom when in a mounted state; and (b) a plurality of cooperative connector elements attached to said knife structure and the protective panel and operative to releasably connect said knife structure to the protective panel so that when said knife structure is connected to said protective panel and the protective panel is positioned in the excavation to buttress the upright wall with said vertex edge contacting the floor of the excavation, said knife structure is operative to advance into the floor as a downward force is applied to the protective panel thereby embedding the protective panel into the floor of the excavation.

2. In a protective structure adapted for use to buttress opposing upright walls of an excavation that has a floor wherein the protective structure has a pair of side panels operative to support each other in a select spaced-apart relationship by a plurality of spreader beams so that the protective structure can be placed into the excavation with each side panel positioned in proximity to a respective one of the upright walls of the excavation, each of the side panels having a bottom edge normally operative to contact the floor of the excavation, the improvement comprising:

(a) a pair of knife structures, each knife structure adapted to be releasably mounted along the bottom edge of a respective side panel, each said knife structure formed by a first knife wall attached to a second knife wall at an acute angle to form a vertex edge and a top wall attached to and between said first knife wall and second knife wall of each of said knife structures and adapted to abut the bottom edge of a respective side panel of the protective structure when said pair of knife structures are releasably connected thereto, each of said knife structures extending coextensively along the bottom edge of its respective side panel of said structure and projecting downwardly therefrom; and (b) a plurality of connector elements attached to each of said knife structures and each side panel of the protective structure and operative to releasably connect each of said knife structures to the respective said side panel so that, when said knife structures are connected to said side panels and the protective structure is positioned in the excavation to buttress the upright walls with said vertex edges contacting the floor of the excavation, said knife structures are operative to advance into the floor as a downward force is applied to the protective structure thereby embedding the protective structure into the floor of the excavation.

3. The improvement according to claim 2 wherein respective ones of said top walls and said first knife walls form a ninety degree angle therebetween when attached to each other.

4. The improvement according to claim 2 including a pair of triangularly-shaped end plates associated with each knife structure, each end plate attached to respective ones of said top walls, said first knife walls and said second knife walls at opposite longitudinal ends of each knife structure.

5. The improvement according to claim 4 wherein said plurality of connector elements of each knife structure are arranged as axially-aligned pairs when said knife structures and the protective panel are releasably connected whereby a first one of each pair is attached to each of said knife structures and a second one of each pair is attached to the protective panel.

6. The improvement according to claim 5 wherein including a threaded rod and a pair of fastening elements associated with each axially-aligned pair of connector elements and adapted to matably engage said threaded rod and wherein each of said connector elements is a lug member adapted to receive end portions of said threaded rod so that each of said pairs of connector elements is interconnected by said threaded rod matably engaged with said pair of fastening elements.

7. The improvement according to claim 2 including a plurality of triangularly-shaped gusset plates attached to at least one of said top wall, said first knife wall and said second knife wall in a spaced-apart parallel relationship to each other between said pair of end plates of respective ones of said knife structures.

8. The improvement according to claim 2 including a first guide wall and a second guide wall associated with each of said knife structures, each of said first and second guide walls being connected to a respective one of said top walls in a spaced apart parallel relationship to each other to form a rectangularly-shaped channel, a respective one of said channels operative to receive a respective bottom edge of each side panel of the panel structure.

9. The improvement according to claim 8 wherein said first guide wall of each of said knife structures is an integral extension of a respective one of said first knife wall defining an outside wall operative to abut the upright sidewall of the excavation when the protective panel is embedded into the floor and said second guide wall and said second knife wall of each of said knife structures are integrally formed at an obtuse angle relative to each other to define a canted inside wall operative to cut the floor of the excavation when the protective panel is being advanced thereinto.

10. The improvement according to claim 2 including a plurality of guide posts attached to and extending perpendicularly from said top wall of each knife structure and a plurality of guide holes formed into the bottom edge of each side panel and arranged to axially align with respective ones of said plurality of guide posts for slidable engagement therewith.

11. In a protective panel adapted to be supported by a brace in order to buttress an upright wall of an excavation that has a floor wherein the protective panel has a bottom edge normally operative to contact the floor of the excavation, the improvement comprising:

(a) a knife structure adapted to be releasably mounted along the bottom edge of said protective panel, said knife structure formed by a first knife wall attached to a second knife wall at an acute angle to form a vertex edge, said knife structure extending coextensively along the bottom edge of the protective panel and projecting downwardly therefrom when in a mounted state; and (b) a plurality of cooperative connector elements attached to said knife structure and the protective panel and operative to releasably connect said knife structure to the protective panel so that, when said knife structure is connected to said protective panel and the protective panel is positioned in the excavation to buttress the upright wall with said vertex edge contacting the floor of the excavation, said knife structure is operative to advance into the floor as a downward force is applied to the protective panel thereby embedding the protective panel into the floor of the excavation, said plurality of connector elements arranged as axially-aligned pairs when said knife structure and the protective panel are releasably connected whereby a first one of each pair is attached to said knife structure and a second one of each pair is attached to the protective panel.

12. The improvement according to claim 11 including a threaded rod and a pair of fastening elements associated with each axially-aligned pair of connector elements and adapted to matably engage said threaded rod and wherein each of said connector elements is a lug member adapted to receive end portions of said threaded rod so that each of said pairs of connector elements is interconnected by said threaded rod matably engaged with said pair of fastening elements.

13. In a protective panel adapted to be supported by a brace in order to buttress an upright wall of an excavation that has a floor wherein the protective panel has a bottom edge normally operative to contact the floor of the excavation, the improvement comprising:

(a) a knife structure adapted to be releasably mounted along the bottom edge of said protective panel, said knife structure formed by a first knife wall attached to a second knife wall at an acute angle to form a vertex edge and a top wall attached to and between said first and second knife walls, said knife structure extending coextensively along the bottom edge of the protective panel with said top wall abutting the bottom edge thereof and with said knife structure projecting downwardly therefrom when in a mounted state; and (b) a plurality of cooperative connector elements attached to said knife structure and the protective panel and operative to releasably connect said knife structure to the protective panel so that when said knife structure is connected to said protective panel and the protective panel is positioned in the excavation to buttress the upright wall with said vertex edge contacting the floor of the excavation, said knife structure is operative to advance into the floor as a downward force is applied to the protective panel thereby embedding the protective panel into the floor of the excavation.

14. The improvement according to claim 13 wherein said top wall and said first knife wall form a ninety degree angle therebetween when attached to each other.

15. The improvement according to claim 13 including a pair of triangularly-shaped end plates, each end plate attached to said top wall, said first knife wall and said second knife wall at opposite longitudinal ends of said knife structure.

16. The improvement according to claim 15 including a plurality of triangularly-shaped gusset plates attached to at least one of said top wall, said first knife wall and said second knife wall in a spaced-apart parallel relationship to each other between said end plates.

17. The improvement according to claim 13 including a first guide wall and a second guide wall, each of said guide walls connected to said top wall in a spaced apart parallel relationship to each other to form a rectangularly-shaped channel, said channel operative to receive the bottom edge of the panel structure.

18. The improvement according to claim 17 wherein said first guide wall is an integral extension of said first knife wall defining an outside wall operative to abut the upright sidewall of the excavation when the protective panel is embedded into the floor and said second guide wall and said second knife wall are integrally formed at an obtuse angle relative to each other to define a canted inside wall operative to cut the floor of the excavation when the protective panel is being advanced thereinto.

19. The improvement according to claim 13 including a plurality of guide posts attached to and extending perpendicularly from said top wall of said knife structure and a plurality of guide holes formed into the bottom edge of the side panel and arranged to axially align with respective ones of said plurality of guide posts for slidable engagement therewith.

* * * * *